US006477799B1

(12) United States Patent
Erickson et al.

(10) Patent No.: US 6,477,799 B1
(45) Date of Patent: Nov. 12, 2002

(54) SELF-ORIENTING LOGO ASSEMBLY

(75) Inventors: Carol Erickson, Cypress, TX (US); Kenneth Jansen, Spring, TX (US); David R. Wooten, Escondido, TX (US); Guy McSwain, Cypress, TX (US); Michael F. Angelo, Houston, TX (US); Keith Lutsch, Houston, TX (US)

(73) Assignee: Compaq Information Technologies Group, L.P., Houston, TX (US)

( * ) Notice: Subject to any disclaimer, the term of this patent is extended or adjusted under 35 U.S.C. 154(b) by 0 days.

(21) Appl. No.: 09/523,858

(22) Filed: Mar. 13, 2000

(51) Int. Cl.[7] ..... G09F 19/00

(52) U.S. Cl. ..... 40/406; 40/409; 40/422; 40/426; 40/661.01; 446/267

(58) Field of Search ..... 40/1.5, 1.6, 406, 40/409, 421, 422, 426, 600, 661.01, 661.05, 661.11; 446/267

(56) References Cited

U.S. PATENT DOCUMENTS 1,756,021 A * 4/1930 Escasena ..... 40/587
2,659,169 A * 11/1953 Brennan ..... 40/1.5
2,869,262 A * 1/1959 Lucas ..... 40/587
2,954,629 A * 10/1960 Matin ..... 40/587
3,168,315 A * 2/1965 Bookman ..... 273/145 C
3,839,821 A * 10/1974 Forsman ..... 40/1.5
4,341,035 A * 7/1982 Jaworski et al. ..... 40/587
4,506,950 A * 3/1985 Crossman ..... 40/506
5,190,354 A * 3/1993 Levy et al. ..... 40/587
5,347,733 A * 9/1994 Whittington ..... 40/1.5
5,490,342 A * 2/1996 Rutterman et al. ..... 40/587
5,893,789 A * 4/1999 Wu ..... 446/267

* cited by examiner

*Primary Examiner*—Lynne H. Browne
*Assistant Examiner*—James M. Hewitt
(74) *Attorney, Agent, or Firm*—Fletcher, Yoder & Van Someren

(57) ABSTRACT

A self-orienting logo assembly so that the logo is always in a horizontal orientation. In the preferred embodiments the logo is located on a disk. The disk is weighted or otherwise designed to have its weight distributed nonuniformly. The disk is located inside a housing. The housing is attached to the computer or other equipment bearing the logo. When the housing is located in a vertical plane the disk rotates to allow the logo to remain horizontal. The disk can be rotationally mounted to the housing or can be suspended in liquid. In an alternate embodiment the disk can have a magnet incorporated so that when the disk is in a horizontal orientation it can act as a compass. In another embodiment a portion of the disk is removed and the housing contains an additional logo or wording. The rotation of the disk can then cover or expose the additional logo or wording.

22 Claims, 4 Drawing Sheets

SELF-ORIENTING LOGO ASSEMBLY

BACKGROUND OF THE INVENTION

1. Field of the Invention

The invention relates to logos used on products, and more particularly to a logo assembly that automatically orients itself to a horizontal position.

2. Description of the Related Art

Computers and other products commonly include a logo to indicate the manufacturer and/or model of the unit. The logo is firmly attached to the unit, usually by some form of adhesive or by direct printing. The logo can be directly printed on the unit, may be on a clear or colored tape or film or can be on a more substantial material such as a small piece of plastic or metal. The logo is located and oriented so that it is readily visible to the causal observer.

When the computer or other product is located in an office or other environment where space saving is desired and can be configured for an individual, the unit may be installed in various orientations. For example, a desktop computer may be installed in a horizontal orientation if located on or under a desk but is often installed in a vertical orientation if located next to a desk. Computer manufacturers have addressed this difference in installations by providing computers that can be readily installed in either manner. For example, the Compaq® Deskpro® EP computer series is designed to switch from desktop to minitower configurations. The user just slides the external drives (floppy and CD-ROM) out of the chassis, rotates them 90 degrees and slides them back in. The unit can then be placed in the desired orientation.

While this flexibility in design is very useful to the user, it creates problems with the logo. The logo is permanently affixed to the front bezel. In the example of the Deskpro® EP, the logo is attached to be read in a horizontal position. However, when the unit is rotated to the minitower or vertical orientation, the logo is now vertical and not easily read by an observer. The manufacturer could provide a different front bezel for the alternative orientation, but this would not be cost effective. Alternatively the logo could be made removable, but then the logo might be lost completely.

Therefore it would be desirable to have a logo that automatically adjusts for the orientation of the product so that it is always visible to the observer at the desired orientation.

SUMMARY OF THE INVENTION

The present invention provides a self-orienting logo assembly so that the logo is always in a horizontal orientation. In one exemplary embodiment, the logo is located on a disk. The disk is weighted or otherwise designed to have its weight distributed nonuniformly. The disk is located inside a housing. The housing is attached to the computer or other equipment bearing the logo. When the housing is located in a vertical plane the disk rotates to allow the logo to remain horizontal. The disk can be rotationally mounted to the housing or can be suspended in liquid.

In another embodiment, the disk includes a magnet incorporated so that when the disk is in a horizontal orientation it can act as a compass. In another embodiment, a portion of the disk is removed and the housing contains an additional logo or wording. Rotation of the disk covers or exposes the additional logo or wording.

BRIEF DESCRIPTION OF THE DRAWINGS

A better understanding of the invention can be had when the following detailed description of the preferred embodiments is considered in conjunction with the following drawings in which.

"COMPAQ" is a registered trademark of Compaq Computer Corporation.

DETAILED DESCRIPTION OF THE PREFERRED EMBODIMENTS

Figure 1A:
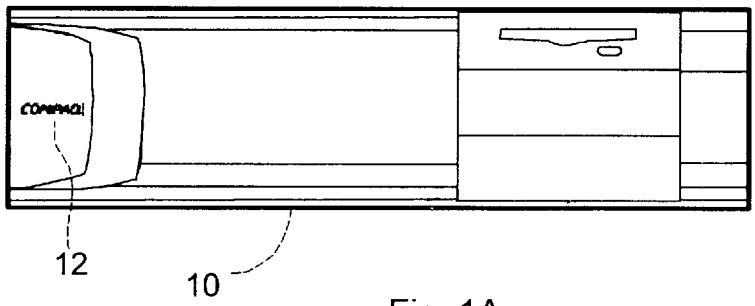
Fig. 1A Prior Art
FIGS. 1A and 1B are horizontal and vertical orientations of units according to the prior art.
Figure 1B:
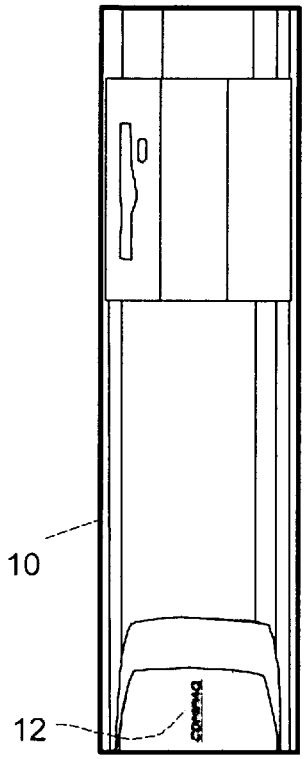
Fig. 1B Prior Art

Referring to FIGS. 1A and 1B, a computer 10 according to the prior art is shown. A logo 12 is aligned along the longitudinal axis of the computer 10. When the computer 10 is in a horizontal or desktop orientation, the logo 12 is readily readable by a casual observer. However, when the computer 10 is in a vertical or minitower orientation, the logo 12 is also in a vertical orientation and thus not readily readable by the casual observer.

Figure 2A:
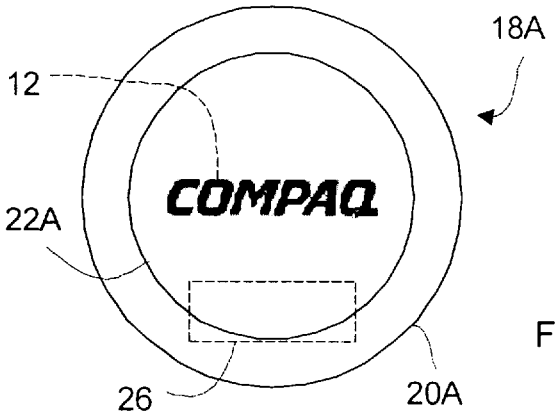
FIGS. 2A and 2B are front and side views of a first embodiment of the present invention.
Figure 2B:
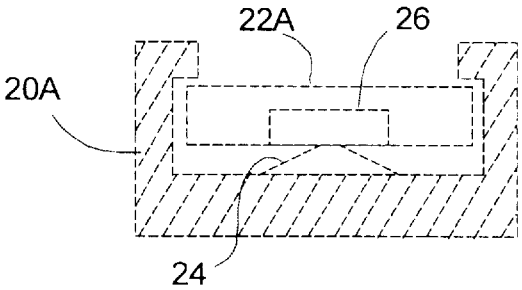

A first embodiment of a logo assembly 18A according to the present invention is shown in FIGS. 2A and 2B. A housing 20A contains a rotatable member, such as a disk 22A. The illustrated logo 12 is located on the front face of the disk 22A, but it also can be located within the rotatable member or on a back surface if, for example, the rotatable member is transparent or translucent. The disk 22A is located or centered in the housing 20A by a pivot 24. Pivot 24 is illustrated as supporting the disk 22A at its center, but pivot 24 can also be designed to support the disk 22A at an outlying or peripheral region of the disk while still permitting pivotable motion about a central rotational axis of the disk 22A. Further, the pivot 24 allows the disk 22A to rotate with respect to the housing 20A. The disk 22A includes a weight 26, the weight 26 generally being aligned in the disk with respect to the logo 12 so that when the disk 22A is located in a vertical plane, the weight 26 causes the logo 12 to orient to a horizontal orientation.

Figure 2C:
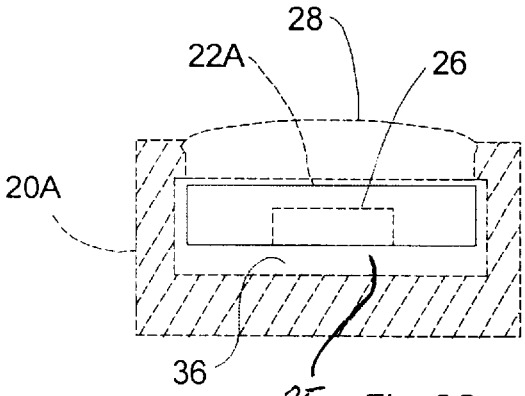
FIG. 2C is a side view of an alternate embodiment of the first embodiment.

In an alternate embodiment, as shown in FIG. 2C, a cover, such as a lens 28, can cover and close the housing 20A to form an interior region 35, that is preferably sealed. A liquid 36 can then be provided in interior region 35 to partially or fully fill the housing 20A, and the disk 22A can float in the liquid 36. The liquid 36 effectively allows the disk 22A to pivot about its rotational axis.

Figure 3A:
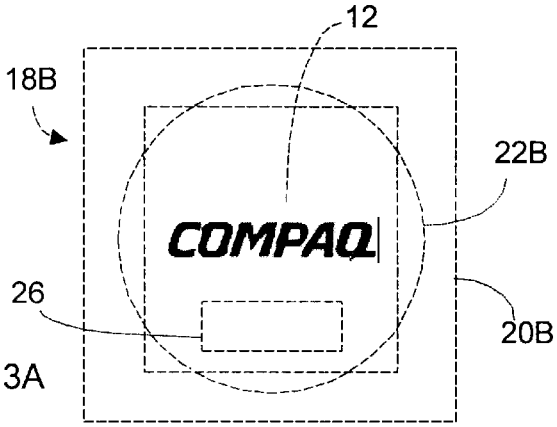
FIGS. 3A and 3B are front and side views of a second embodiment of the present invention.
Figure 3B:
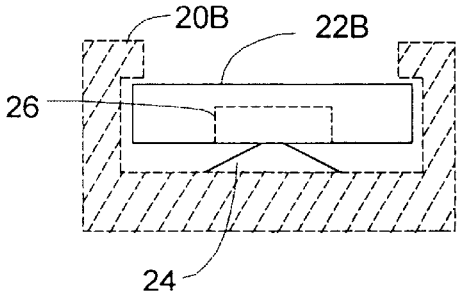

As shown in FIGS. 3A and 3B, a housing 20B having a generally rectangular configuration is shown, as opposed to the generally circular shape of the housing 20A. A disk 22B is larger in diameter to be positively retained in the housing 22B. The housing can have other shapes and configurations to allow it to be more readily mounted in a computer or other product.

Figure 4A:
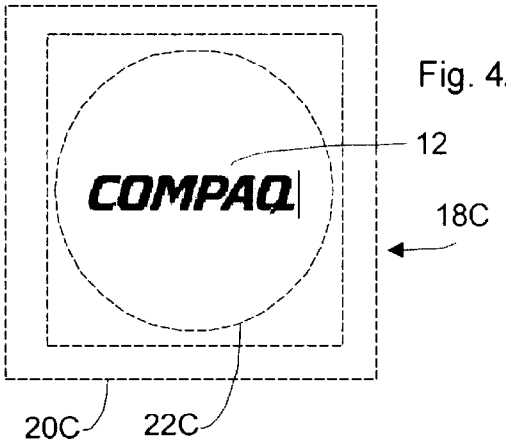
FIGS. 4A, 4B and 4C are front, side and rear views of a third embodiment of the present invention.
Figure 4B:
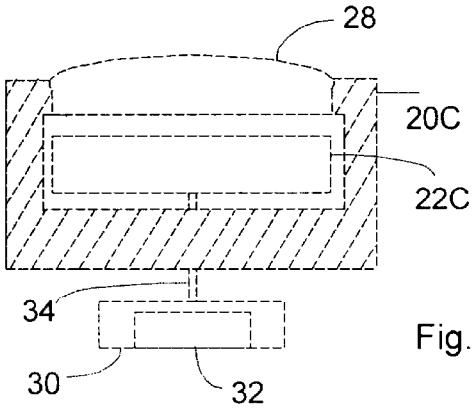
Figure 4C:
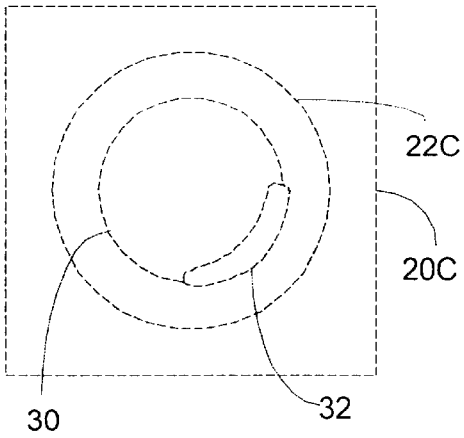

Another alternative embodiment is shown in FIGS. 4A, 4B and 4C. In this variation a housing 20C is generally rectangular and contains disk 22C. The disk 22C is generally smaller in diameter than the disk 22B as the disk 22C does not have to be positively retained by the housing 20C. A shaft 34 mounted to the center of the disk 22C exits the rear of the housing 20C. A weighted disk 30 is mounted to the second end of the shaft 34. The weighted disk 30 contains a weight 32 or is otherwise unbalanced in the manner of the disk 22A. The disk 22C is located with respect to the disk 30 and weight 32 so that the logo 12 is oriented to a horizontal position when the assembly 18C is mounted in a vertical orientation.

Figure 5A:
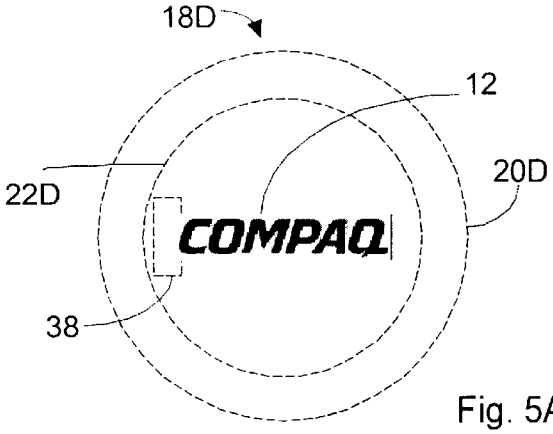
FIGS. 5A and 5B are front and side views of a fourth embodiment of the present invention.
Figure 5B:
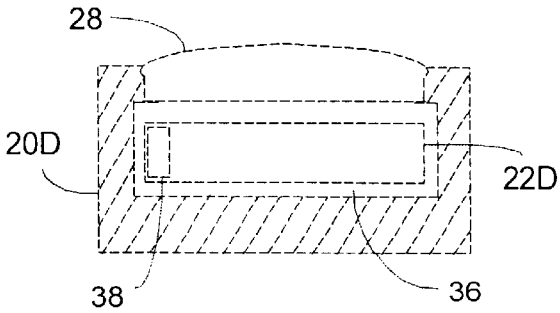

Yet a further alternative embodiment is shown in FIGS. 5A and 5B. In the assembly 18D, the disk 22D includes a magnet 38 instead of a weight. In the illustrated embodiment, the disk 22D is suspended in a liquid 36 contained in the housing 20D, but other pivot mechanisms can be used to allow the disk 22D to freely rotate. A transparent or translucent cover, e.g., lens 28, seals the housing 20D. When the assembly 18D is located in a horizontal plane, the disk 22D aligns itself with the earth's magnetic poles, performing as a compass. This embodiment can be installed in a laptop computer or other portable product.

Figure 6B:
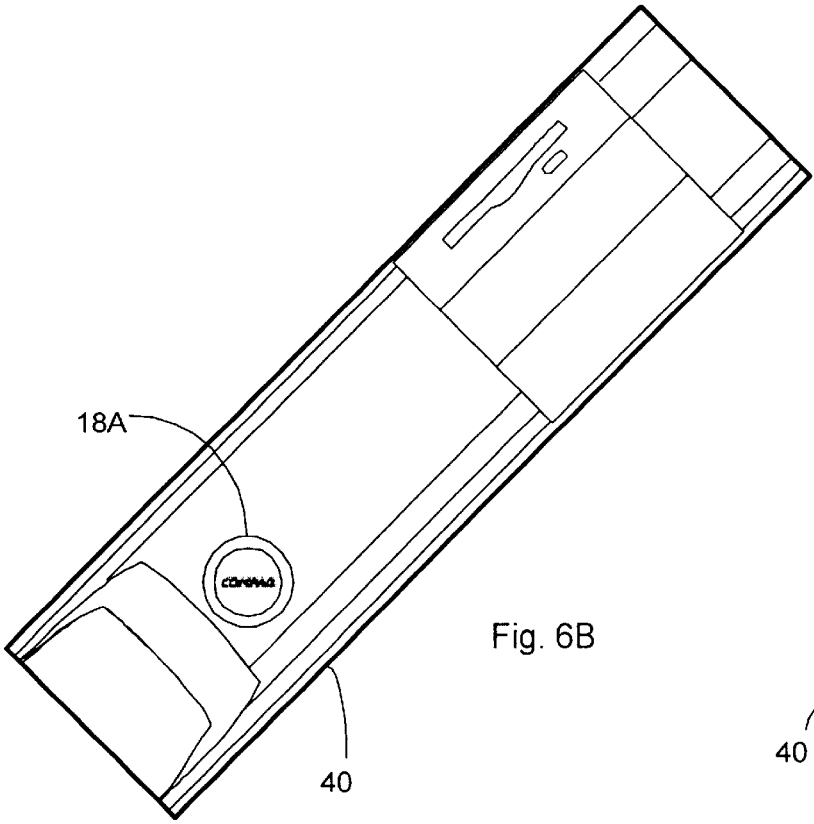
FIGS. 6A, 6B and 6C are vertical, angled and horizontal views of units incorporating the embodiment of FIG. 2A.
Figure 6A:
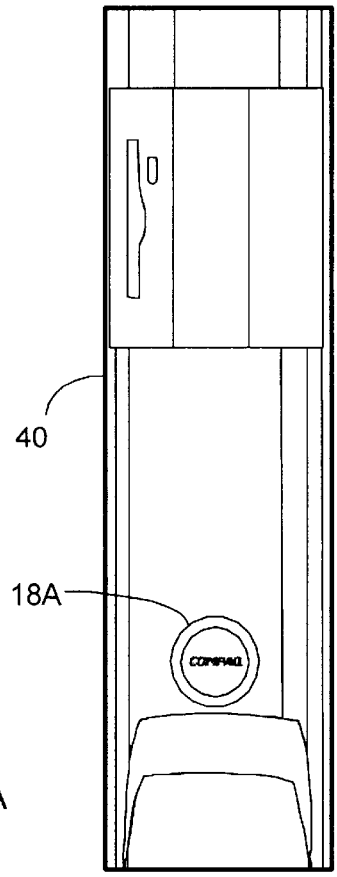
Figure 6C:
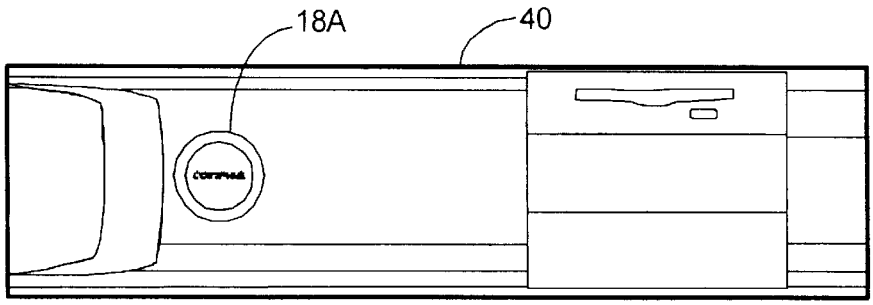

Operation of an assembly according to the present invention is shown in FIGS. 6A, 6B and 6C. The assembly 18A is installed in a computer 40. The logo 12 is in a horizontal orientation when the computer 40 is in a vertical orientation. In FIG. 6B the computer 40 is rotated to a 45 degree angle. The disk 22A in the assembly 18A rotates so that the logo 12 remains horizontal. In FIG. 6C the computer 40 is in a horizontal configuration, as is the logo 12. The disk 22A has further rotated inside the housing 20A so that the logo 12 remains horizontal. Thus, the casual observer always sees the logo 12 in the desirable horizontal orientation.

Figure 7:
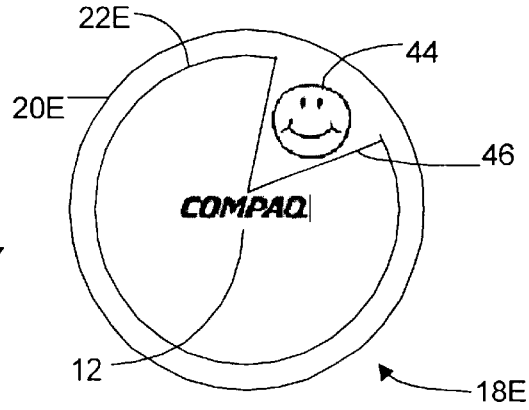
FIG. 7 is a front view of a fifth embodiment of the present invention.

Yet one more embodiment is shown in FIG. 7. In an assembly 18E, the housing 20E and the disk 22E are larger than the similar assembly 18A. The logo 12 is substantially the same size. In this case the disk 22E has a portion 46 removed, e.g. a wedge shaped portion, such that the removal of the portion 46 creates an opening through the disk 22E. A second logo 44 is located on the housing 20E. The second logo 44 is sized so that it can be viewed through the opening in the disk 22E.

Figure 8B:
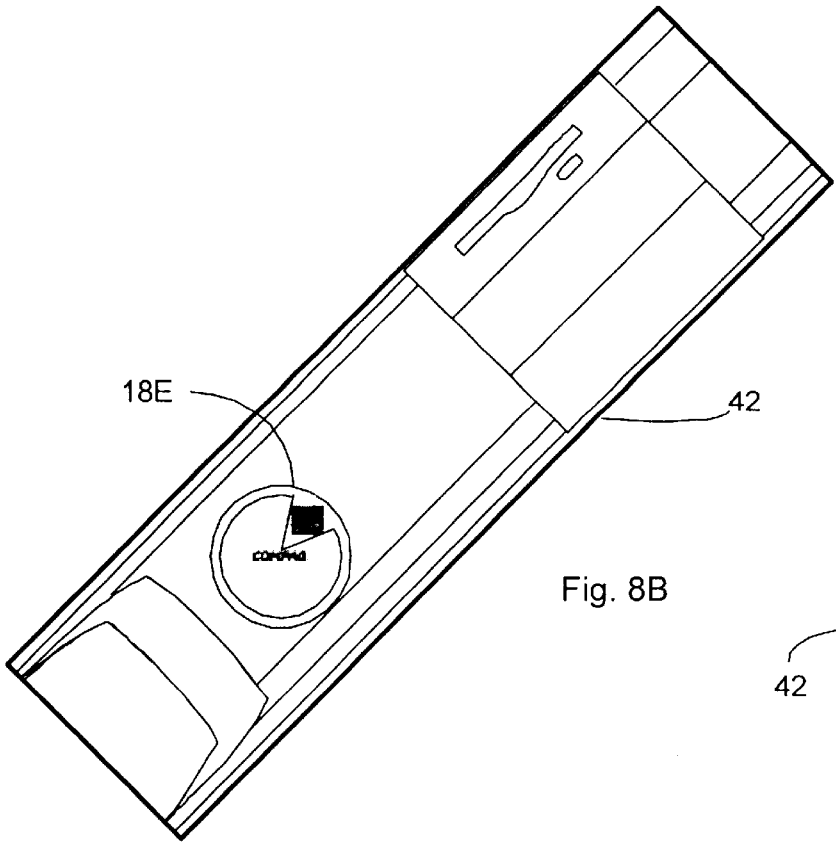
FIGS. 8A, 8B and 8C are vertical, angled and horizontal views of units incorporating the embodiment of FIG. 7.
Figure 8A:
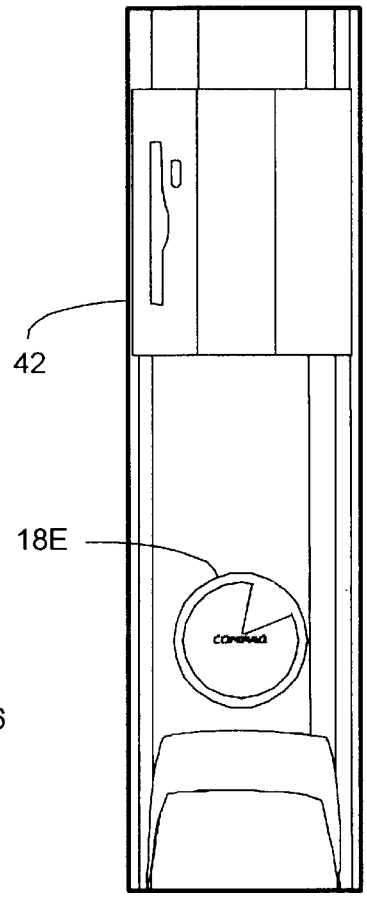
Figure 8C:
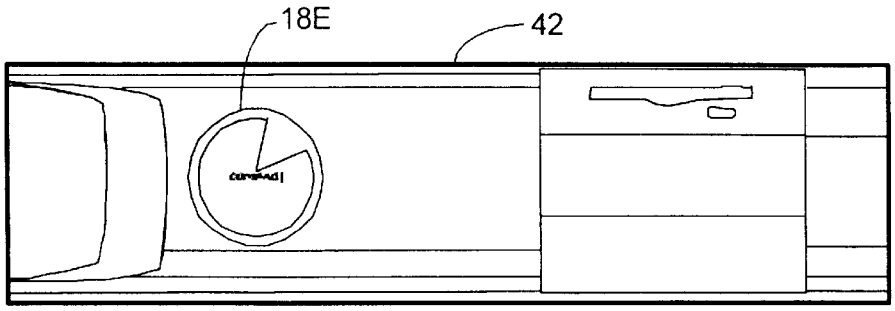

Operation of the assembly 18E is shown in FIGS. 8A, 8B and 8C. In FIG. 8A, a computer 42 includes the assembly 18E. The second logo 44 is not visible in the vertical orientation of the computer 42. As the computer 42 is rotated to a 45 degree angle, as illustrated in FIG. 8B, the disk 22E rotates and the second logo 44 becomes visible. When the computer 42 reaches the horizontal position in FIG. 8C, the disk 22E has further rotated and the second logo 44 is again covered.

It is understood that the removed portion 46 and the second logo 44 can be positioned at other locations so that the second logo 44 is visible at other desired orientations of the computer 42.

In an alternate version, a larger portion of the disk 22E can be removed. Then a larger amount of information, such as wording indicating that the product is oriented upside down can located on the housing 20E. When the assembly is properly mounted in the product, the user receives a warning when the product is upside down. It is understood that other warnings or notices could be provided.

While the preferred embodiments have been described with respect to a computer, it is understood that the assembly can be used with any product having a logo where there is a chance that the product can be used in several orientations. Also, the embodiments illustrated have been described with a pivotable disk, but other shapes, e.g. semicirles, squares, triangles, can be mounted for pivotable motion in accordance with the present invention. Additionally one skilled in the art can readily develop other arrangements to allow the disk to rotate inside the housing. Further, the disk can be used with a shaft and weighted disk without a housing by having the shaft rotate directly in the bezel or cover of the product.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

We claim:

1. A computer system, comprising:

a computer;

a logo; and a rotating portion, wherein the logo is attached to the rotating portion and the rotating portion is mounted to the computer, the rotating portion automatically maintaining the logo in a desired orientation when the computer is placed in a selected orientation chosen from a plurality of potential orientations.

2. The computer system as recited in claim 1, further comprising a housing having an interior region for receiving the rotating portion.

3. An apparatus that may be mounted to a computer, comprising:

a logo;

a rotating portion, wherein the logo is attached to the rotating portion and the rotating portion is mounted to the computer, the rotating portion automatically maintaining the logo in a desired orientation when the computer is placed in a selected orientation chosen from a plurality of potential orientations; and a housing having an interior region for receiving the rotating portion, wherein the interior region is at least partially filled with a liquid and the rotating portion is disposed in contact with the liquid.

4. The apparatus as recited in claim 3, wherein the rotating portion floats in the liquid.

5. The apparatus as recited in claim 3, wherein the rotating portion is unbalanced.

6. An apparatus that may be mounted to a computer comprising:

a logo;

a rotating portion, wherein the rotating portion comprises a magnet, such that the logo is attached to the rotating portion, the rotating portion automatically maintaining the logo in a desired orientation when the computer is placed in a selected orientation chosen from a plurality of potential orientations; and a housing having an interior region for receiving the rotating portion.

7. The computer system as recited in claim 2, wherein the rotating portion comprises a disk.

8. The computer system as recited in claim 1, further comprising a center pivot, wherein the rotating portion is mounted on the center pivot for pivotable motion.

9. The computer system as recited in claim 8, wherein the center pivot includes a shaft affixed to the rotating portion.

10. The computer system as recited in claim 8, wherein the rotating portion comprises a disk.

11. A system that may be placed in a plurality of orientations, comprising:

a self-orienting member having an opening therethrough;

a product having a product housing to which the self-orienting member is mounted, the product housing being positionable in an upright position; and an indicia on the product housing, wherein the indicia is visible through the opening when the product is tilted from the upright position.

12. The system as recited in claim 11, wherein the indicia is visible when the product is tilted approximately 45 degrees from the upright position.

13. The system as recited in claim 11, wherein the opening is generally wedge shaped.

14. The system as recited in claim 11, wherein the indicia comprises a logo.

15. The system as recited in claim 14, further comprising a second logo disposed on the self-orienting member.

16. The system as recited in claim 11, wherein the self-orienting member is generally in the shape of a disk.

17. The system as recited in claim 11, further comprising a self-orienting member housing, wherein the self-orienting member housing is a separate member fastened to the product.

18. The system as recited in claim 11, wherein the product comprises a computer.

19. The system as recited in claim 11, wherein the product housing has an interior region for receiving the self-orienting member.

20. The system as recited in claim 11, wherein the self-orienting member is rotatably mounted to the product housing by a shaft.

21. A system that may be placed in a plurality of orientations, comprising:

a self-orienting member having an opening therethrough;

a product having a product housing to which the self-orienting member is mounted, the product housing being positionable in an upright position;

the product housing further comprising of an interior region for receiving the self-orienting member, wherein the interior region is at least partially filled with a liquid; and an indicia on the product housing, wherein the indicia is visible through the opening when the product is tilted from the upright position.

22. A system as recited in claim 21, wherein the self-orienting member floats in the liquid and is unbalanced to maintain a desired orientation regardless of the tilt of the product.

* * * * *